US005435620A

United States Patent [19]

Cheng

[11] Patent Number: 5,435,620

[45] Date of Patent: Jul. 25, 1995

[54] FOLDABLE CHAIR

[76] Inventor: Kuen-Pao Cheng, No. 1, Lane 10, Chung Yi Street, Yung Kang Shih, Tainan Hsien, Taiwan

[21] Appl. No.: 243,893

[22] Filed: May 17, 1994

[51] Int. Cl.[6] ..... A47C 4/20

[52] U.S. Cl. ..... 297/51; 108/132; 297/16.1; 248/150; 403/70; 403/71

[58] Field of Search ..... 297/16.1, 34, 51–55, 297/440.1, 445; 108/132, 115; 248/150; 403/6, 70, 71

[56] References Cited

U.S. PATENT DOCUMENTS

| | | | |
|---|---|---|---|
| 1,369,633 | 2/1921 | Dietrich et al. | 297/51 |
| 3,669,392 | 6/1972 | Saunders | 248/150 X |
| 5,078,056 | 1/1992 | McCauley | 108/9 X |

FOREIGN PATENT DOCUMENTS

| | | | |
|---|---|---|---|
| 329407 | 9/1935 | Italy | 297/52 |
| 301699 | 6/1968 | Sweden | 403/65 |

*Primary Examiner*—Peter R. Brown
*Attorney, Agent, or Firm*—Pro-Techtor International

[57] ABSTRACT

A chair includes a seat frame and a base frame each having a pair of rods coupled to a support frame by four couplers. Each of the couplers has a groove for engaging with the rods of the seat frame and the base frame. The seat frame and the base frame can be supported in parallel with each other when the rods are engaged in the grooves of the couplers. The seat frame and the base frame can be rotated to contact with the support frame when the rods are disengaged from the grooves of the couplers, so as to form a compact configuration.

2 Claims, 5 Drawing Sheets

FOLDABLE CHAIR

BACKGROUND OF THE INVENTION

1. Field of the Invention

The present invention relates to a chair, and more particularly to a foldable chair.

2. Description of the Prior Art

Typical foldable chairs comprise a pair of base frames having a middle portion pivotally coupled together, and a seat portion coupled between one end portions of the base frames. Normally, the base frames and the seat portion may not be folded to a rather compact configuration.

The present invention has arisen to mitigate and/or obviate the afore-described disadvantages of the conventional foldable chairs.

SUMMARY OF THE INVENTION

The primary objective of the present invention is to provide a foldable chair which may be folded to a compact configuration which is good for transportation purposes.

In accordance with one aspect of the invention, there is provided a chair comprising a seat frame including a pair of first rods having rear ends; a base frame including a pair of second rods having front ends; a support frame including a pair of posts having upper ends and lower ends; and four couplers fixed to the upper ends and the lower ends of the posts, each of the couplers including a groove formed therein, the rear ends of the first rods and the front ends of the second rods being pivotally coupled to the couplers at one end of the grooves; the seat frame and the base frame being supported in parallel with each other when the rods are engaged in the grooves of the couplers, and the seat frame and the base frame being rotated to contact with the support frame when the rods are disengaged from the grooves of the couplers.

The rear ends of the first rods each includes a bracket secured thereto, the chair further comprises a back frame including a pair of bars having lower ends pivotally coupled to the brackets, the back frame is supported in perpendicular to the seat frame for forming a back support of the chair and folded to contact with the support frame when folded.

Further objectives and advantages of the present invention will become apparent from a careful reading of a detailed description provided hereinbelow, with appropriate difference to accompanying drawings.

DETAILED DESCRIPTION OF THE PREFERRED EMBODIMENT

Figure 1:
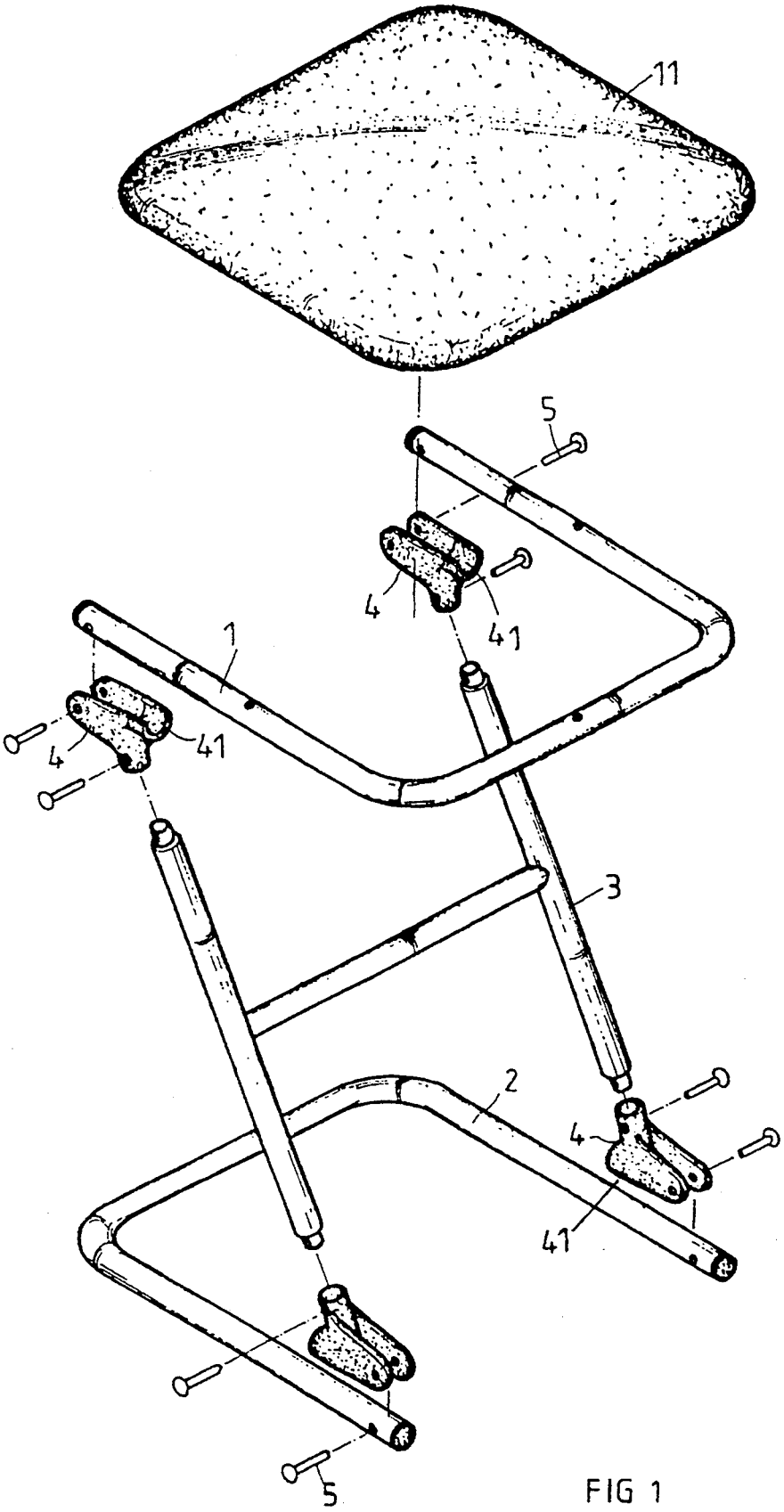
FIG. 1 is an exploded view of a foldable chair in accordance with the present invention.
Figure 2:
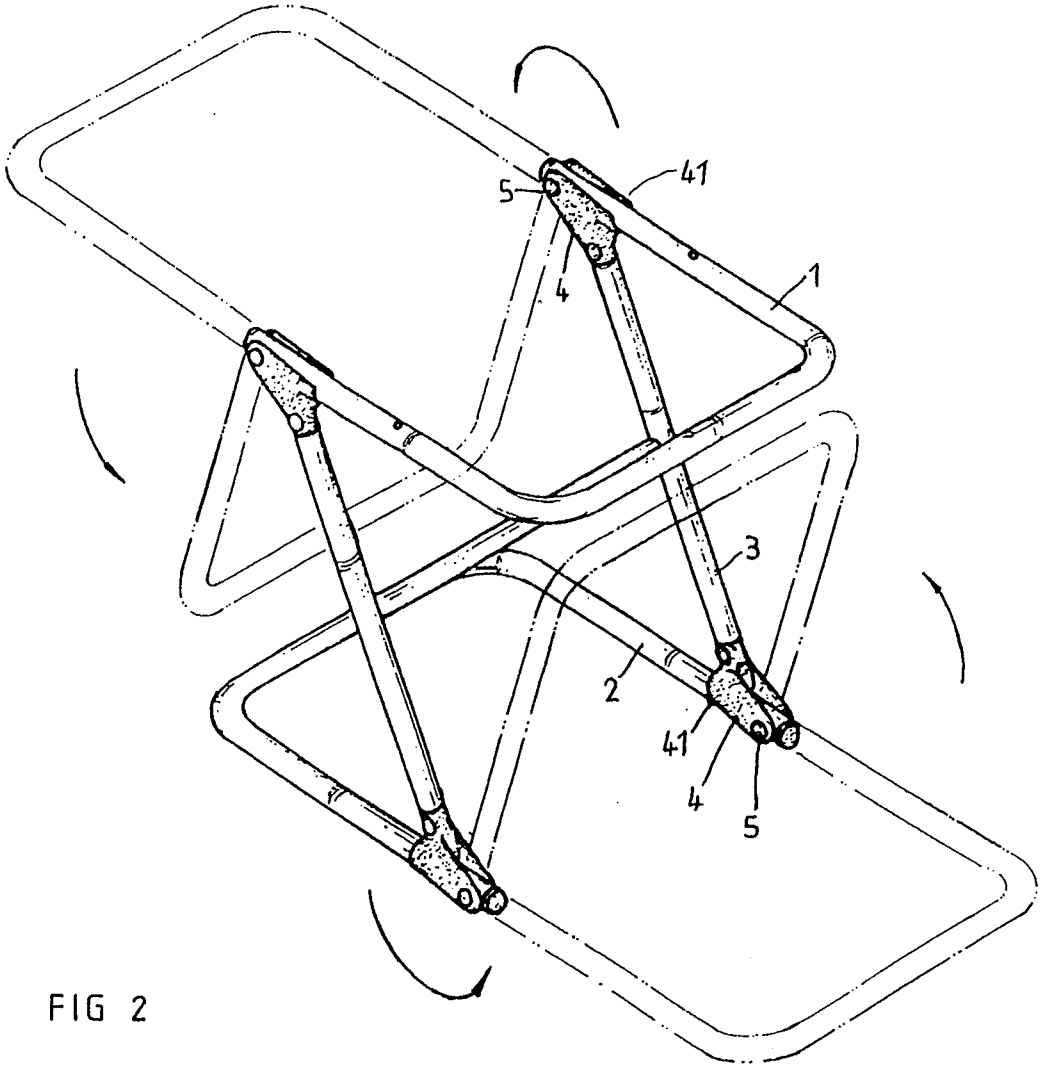
FIG. 2 is a perspective view illustrating the frame portion of the foldable chair.
Figure 3:
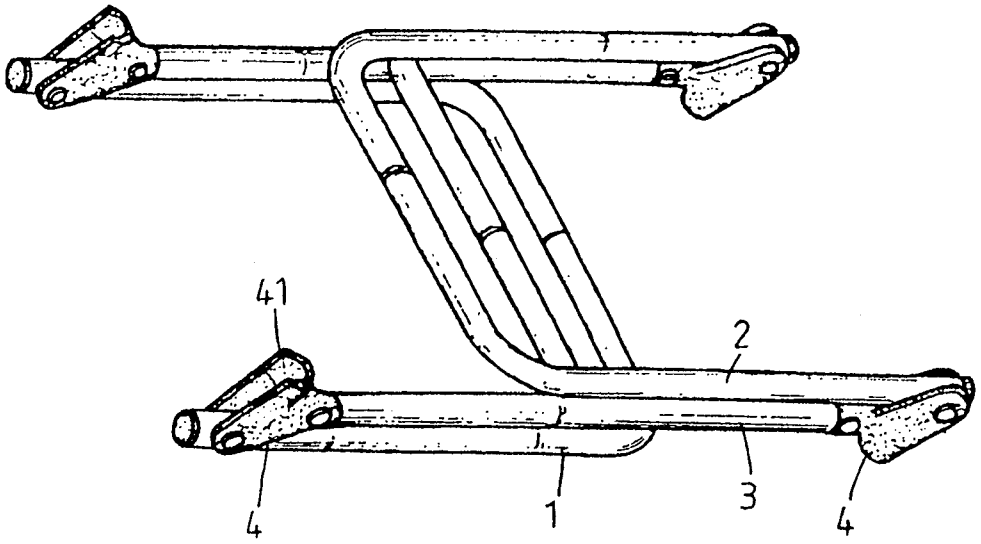
FIG. 3 is a perspective view illustrating the folded configuration of the frame portion of the foldable chair.

Referring to the drawings, and initially to FIGS. 1 to 3, a foldable chair in accordance with the present invention comprises a seat frame 1, a base frame 2 and a support frame 3 pivotally coupled together by four couplers 4. A seat cushion 11 is engaged on the seat frame 1. The support frame 3 include a pair of parallel posts having lower ends and upper ends. The couplers 4 are fixed to the lower ends and the upper ends of the posts of the support frame 3. Each of the couplers 4 includes a groove 41 formed therein. The seat frame 1 and the base frame 2 each includes a pair of parallel rods engagable with the grooves 41 and pivotally coupled to the couplers 4 by pin elements 5.

In operation, as shown in FIG. 2, the seat frame 1 and the base frame 2 are supported in parallel with each other by the couplers 4 such that the chair is readily for use. However when the seat frame 1 and the base frame 2 are folded about the pin elements 5, as shown in FIGS. 2 and 3, the seat frame 1 and the base frame 2 can be folded to a position superposing with the support frame 3, such that the chair can be folded to a rather compact configuration.

Figure 4:
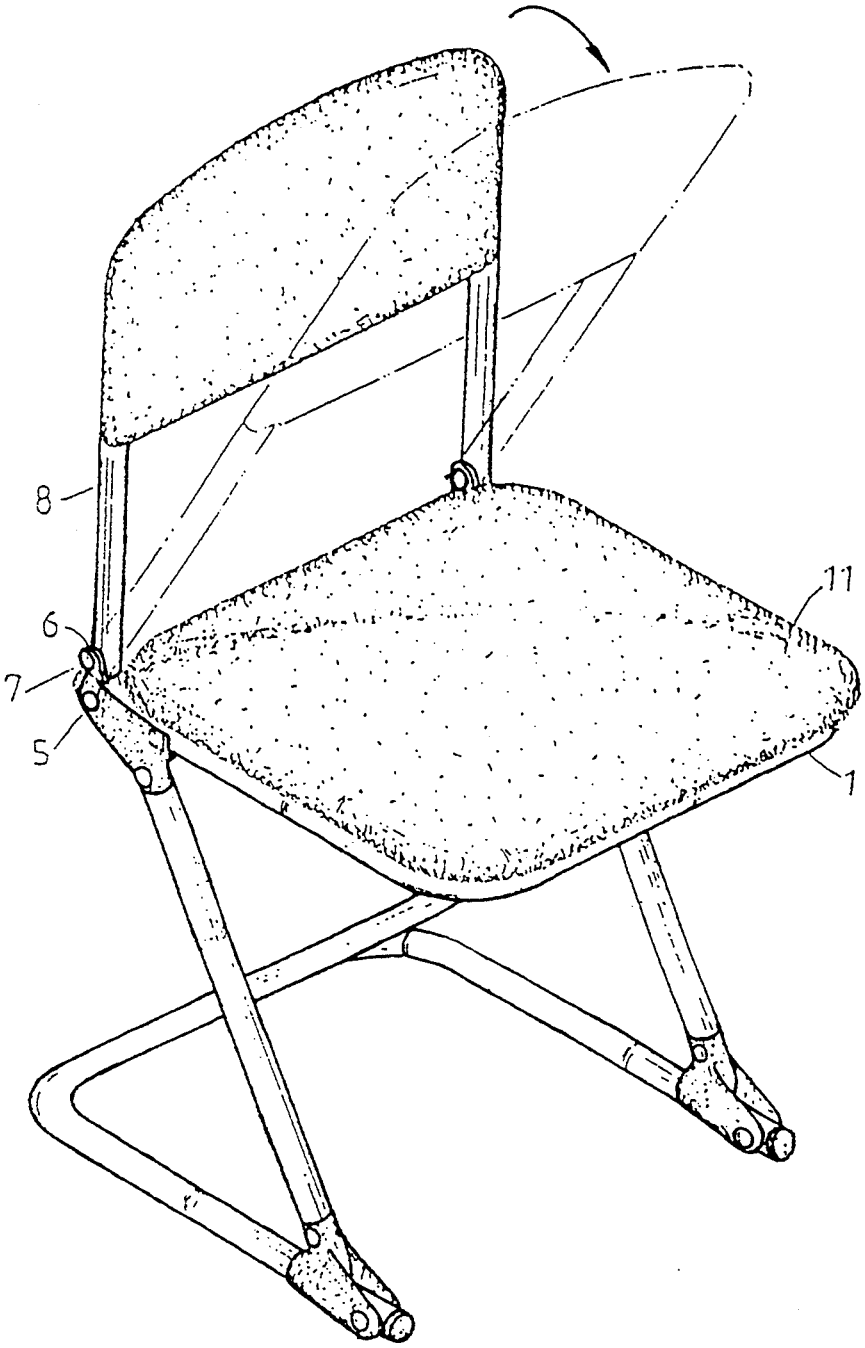
FIG. 4 is a perspective view illustrating the foldable chair having a back frame coupled thereto.
Figure 5:
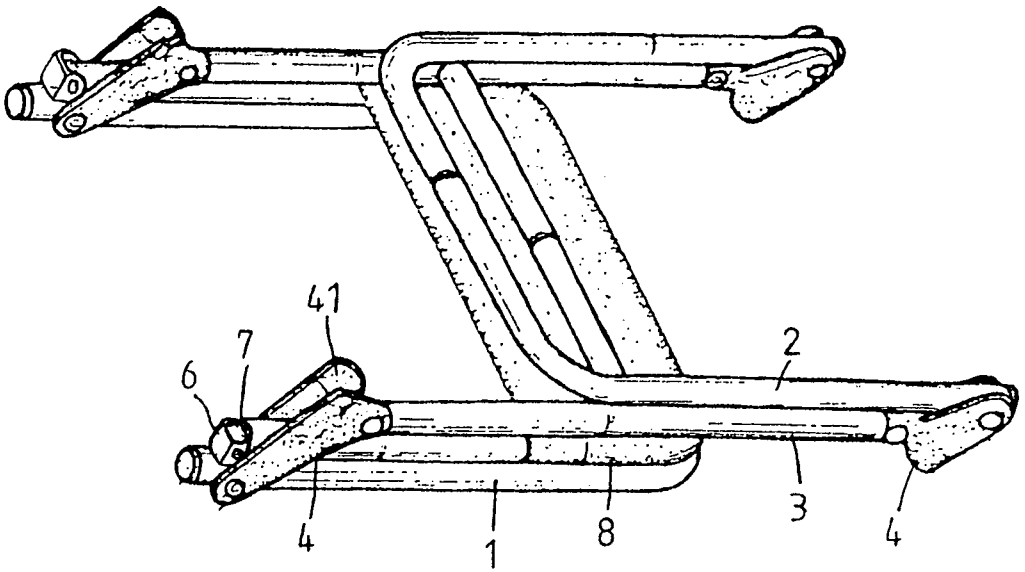
FIG. 5 is a perspective view illustrating the folded configuration of the foldable chair.

Referring next to FIGS. 4 and 5, the rear ends of the rods of the seat frame 1 each includes a bracket 6 pivotally coupled thereto, and a back frame 8 includes a pair of bars having one end pivotally coupled to the brackets 6 by a pin element 7. The back frame 8 may be supported in a vertical position and in perpendicular to the seat frame 1, as shown in FIG. 4. When folded, the back frame 8 and the seat frame 1 may both be folded a position in parallel with the support frame 3.

Accordingly, the foldable chair in accordance with the present invention may be folded to a rather compact configuration which is good for transportation purposes.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A chair comprising a seat frame including a pair of first rods having rear ends; a base frame including a pair of second rods having front ends; a support frame including a pair of posts having upper ends and lower ends; and four couplers fixed to said upper ends and said lower ends of Said posts, each of said couplers including a groove formed therein, said rear ends of said first rods and said front ends of said second rods being pivotally coupled to said couplers at one end of said grooves; said seat frame and said base frame being supported in parallel with each other when said rods are engaged in said grooves of said couplers, and said seat frame and said base frame being rotated to contact with said support frame when said rods are disengaged from said grooves of said couplers.

2. A chair according to claim 1, wherein said rear ends of said first rods each includes a bracket secured thereto, said chair further comprises a back frame including a pair of bars having lower ends pivotally coupled to said brackets, said back frame is supported in perpendicular to said seat frame for forming a back support of said chair and folded to contact with said support frame when folded.

* * * * *